US008322102B2

(12) United States Patent
Krieger

(10) Patent No.: US 8,322,102 B2
(45) Date of Patent: Dec. 4, 2012

(54) WALL PANEL SYSTEM

(75) Inventor: Kevin Krieger, New Philadelphia, OH (US)

(73) Assignee: Marlite, Inc., Dover, OH (US)

( * ) Notice: Subject to any disclaimer, the term of this patent is extended or adjusted under 35 U.S.C. 154(b) by 0 days.

(21) Appl. No.: 13/417,945

(22) Filed: Mar. 12, 2012

(65) Prior Publication Data

US 2012/0167523 A1 Jul. 5, 2012

Related U.S. Application Data

(63) Continuation of application No. 12/449,235, filed as application No. PCT/US2008/001182 on Jan. 30, 2008, now Pat. No. 8,151,533.

(60) Provisional application No. 60/898,779, filed on Feb. 1, 2007.

(51) Int. Cl.
*E04B 2/30* (2006.01)

(52) U.S. Cl. ..... 52/489.1; 52/476; 52/235; 52/266; 52/461

(58) Field of Classification Search ..... 52/238.1, 52/266, 348, 460, 476, 479, 483.1, 489.1, 52/489.2, 235, 461, 510–512
See application file for complete search history.

(56) References Cited

U.S. PATENT DOCUMENTS

| | | | | |
|---|---|---|---|---|
| 3,788,021 | A * | 1/1974 | Husler | 52/403.1 |
| 4,045,932 | A | 9/1977 | Bogert | |
| 4,086,739 | A | 5/1978 | Hall | |
| RE30,980 | E | 6/1982 | Potter et al. | |
| 4,356,672 | A | 11/1982 | Beckman et al. | |
| 4,535,577 | A | 8/1985 | Tenser et al. | |
| 4,642,957 | A * | 2/1987 | Edwards | 52/242 |
| 4,660,339 | A | 4/1987 | Paz | |
| 4,680,902 | A | 7/1987 | Stefnik et al. | |
| 4,750,310 | A | 6/1988 | Holcombe | |
| 4,765,111 | A | 8/1988 | Osawa | |
| 4,783,941 | A | 11/1988 | Loper et al. | |
| 4,905,428 | A | 3/1990 | Sykes | |
| 4,918,879 | A | 4/1990 | Bodurow et al. | |
| 4,937,992 | A | 7/1990 | Dawson et al. | |
| 4,980,998 | A | 1/1991 | Amstutz et al. | |

(Continued)

FOREIGN PATENT DOCUMENTS

CA 2198829 A1 8/1998

(Continued)

OTHER PUBLICATIONS

Fry Reglet Architectural Metals, Standard Detail Drawings, Sep. 29, 2005.

(Continued)

*Primary Examiner* — William Gilbert
*Assistant Examiner* — Gisele Ford
(74) *Attorney, Agent, or Firm* — Wegman Hessler & Vanderburg

(57) ABSTRACT

A modular wall system 10 includes a number of decorative panels that are received in an extruded panel frame 22. The panel frames 22 are positioned by connecting them to a wall rail 16 that is attached to the building. The wall rail 16 and the panel frame 22 each have a groove 52, 62 that accepts a fastener or clip 18 by interference or snap fit to attach the panel frame 22 to the wall rail 16. The grooves 52, 62 have a dove-tail shape that permits a snap fit to secure the panels 12 yet permit the panels to be easily removed or reconfigured.

17 Claims, 10 Drawing Sheets

U.S. PATENT DOCUMENTS

| | | | | |
|---|---|---|---|---|
| 4,996,802 | A | 3/1991 | Brown | |
| 5,058,347 | A | 10/1991 | Schuelke et al. | |
| 5,138,803 | A | 8/1992 | Grossen | |
| 5,469,683 | A * | 11/1995 | McKenna et al. | 52/204.591 |
| 5,481,839 | A * | 1/1996 | Lang et al. | 52/235 |
| 5,484,067 | A | 1/1996 | Sothman | |
| 5,579,616 | A | 12/1996 | Farag | |
| 5,644,878 | A | 7/1997 | Wehrmann | |
| 5,644,884 | A | 7/1997 | Dobija | |
| 5,692,345 | A | 12/1997 | Mogaki et al. | |
| 5,694,727 | A | 12/1997 | Dobija | |
| 5,881,518 | A | 3/1999 | Edwards et al. | |
| D407,832 | S | 4/1999 | Dobija | |
| 5,918,437 | A | 7/1999 | Dobija | |
| 6,141,926 | A | 11/2000 | Rossiter et al. | |
| 6,161,347 | A | 12/2000 | Yu et al. | |
| 6,202,377 | B1 | 3/2001 | Krieger | |
| 6,260,324 | B1 | 7/2001 | Miedema et al. | |
| 6,311,441 | B1 | 11/2001 | Beavers et al. | |
| 6,389,778 | B1 | 5/2002 | Strange | |
| 6,427,408 | B1 | 8/2002 | Krieger | |
| D464,153 | S | 10/2002 | Krieger | |
| D465,586 | S | 11/2002 | Krieger | |
| D466,233 | S | 11/2002 | Krieger | |
| D467,670 | S | 12/2002 | Krieger | |
| 6,491,172 | B2 | 12/2002 | Chance et al. | |
| D474,549 | S | 5/2003 | Krieger | |
| D477,423 | S | 7/2003 | Campbell et al. | |
| D479,008 | S | 8/2003 | Krieger | |
| D482,552 | S | 11/2003 | Campbell et al. | |
| 6,658,805 | B1 | 12/2003 | Yu et al. | |
| D486,676 | S | 2/2004 | Campbell et al. | |
| 6,718,717 | B2 | 4/2004 | Henderson et al. | |
| 6,772,890 | B2 | 8/2004 | Campbell et al. | |
| 6,775,953 | B2 | 8/2004 | Burken et al. | |
| 6,792,727 | B2 | 9/2004 | Krieger | |
| 6,799,404 | B2 | 10/2004 | Spransy | |
| 6,802,168 | B1 | 10/2004 | Minnick | |
| 6,889,477 | B1 | 5/2005 | Kottman | |
| 6,993,875 | B2 | 2/2006 | Rudduck | |
| 7,036,280 | B2 * | 5/2006 | Hogan | 52/235 |
| 7,055,287 | B2 | 6/2006 | Yu et al. | |
| D537,544 | S | 2/2007 | Bledsoe et al. | |
| 7,464,509 | B1 | 12/2008 | Brown | |
| 7,546,716 | B1 * | 6/2009 | Asadurian | 52/570 |
| 7,845,120 | B2 * | 12/2010 | Thome et al. | 52/144 |
| 2003/0189019 | A1 | 10/2003 | Campbell et al. | |
| 2004/0139681 | A1 | 7/2004 | Kopish et al. | |
| 2005/0150616 | A1 | 7/2005 | McConnell et al. | |
| 2006/0059806 | A1 | 3/2006 | Gosling et al. | |
| 2007/0284506 | A1 | 12/2007 | Benedict | |
| 2010/0132293 | A1 | 6/2010 | Voegele, Jr. et al. | |

FOREIGN PATENT DOCUMENTS

| | | | |
|---|---|---|---|
| DE | 297 04 548 | U1 | 8/1998 |
| GB | 2128707 | A | 5/1984 |
| JP | 08082013 | A | 3/1996 |
| NL | 1023330 | C2 | 9/2004 |
| WO | WO 81/03194 | A1 | 11/1981 |
| WO | WO 83/01476 | A1 | 4/1983 |
| WO | WO 92/05324 | A1 | 4/1992 |
| WO | WO 94/01639 | A1 | 1/1994 |
| WO | WO 2004/055283 | A1 | 7/2004 |
| WO | WO 2005/078204 | A1 | 8/2005 |

OTHER PUBLICATIONS http://www.fryreglet.com/products.htm, Mar. 15, 2007.

http://www.fryreglet.com/products-interior.htm, Mar. 15, 2007.

http://www.fryreglet.com/graph.htm, Mar. 15, 2007.

http://www.fryreglet.com/graph-how.htm, Mar. 15, 2007.

Fry Reglet Corporation Brochure, 4 pages, 2007.

International Search Report and Written Opinion mailed Nov. 25, 2008 for PCT/US2008/001182 filed Jan. 30, 2008.

International Preliminary Report on Patentability mailed Aug. 13, 2009 for PCT/US2008/001182 filed Jan. 30, 2008.

Canadian Office Action issued May 5, 2011 in related Canadian Application No. 2,676,653.

Canadian Office Action issued Feb. 23, 2012 in related Canadian Patent Application No. 2,676,653.

* cited by examiner

WALL PANEL SYSTEM

CROSS-REFERENCE TO RELATED APPLICATION

This application is a continuation application claiming priority benefit to U.S. patent application Ser. No. 12/449,235 filed Jul. 29, 2009, which claims priority to PCT Application No. PCT/US2008/001182 filed Jan. 30, 2008, which claims the priority benefit of U.S. Provisional Patent Application Ser. No. 60/898,779 filed Feb. 1, 2007.

BACKGROUND OF THE INVENTION

1. Field of Invention

This invention relates to the field modular wall systems, and more particularly, relates to an improved frame and rail system to secure panels in various arrangements in a modular wall system.

2. Description of Related Art

It is known to construct a wall surface for a room or other structure with a plurality of prefinished rectangular panels. Such constructions using a real wood veneer, for example, can achieve a custom high-quality appearance with moderate material and labor costs. The panels usually are constructed with flat or curved cores surrounded by a perimeter frame. Typically, the panels are assembled and interconnected in an edge to edge relationship to form a workspace environment with combinations of continuous walls and corner joints.

Common connection systems, where an edge is constructed with a male connection frame member which engages a vertical female frame member along the longitudinal axis on the adjacent edge, are limited to configurations with standard panel sizes and set angles, thus limiting the flexibility of the system and any reconfiguration thereof. These wall systems tend to be permanent and do not enable disassembly without damaging the panel members. This limits options available during reconfiguration.

BRIEF DESCRIPTION OF THE DRAWINGS

The structure, operation, and advantages of the presently disclosed embodiment of the invention will become apparent when consideration of the following description taken in conjunction with the accompanying drawings wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
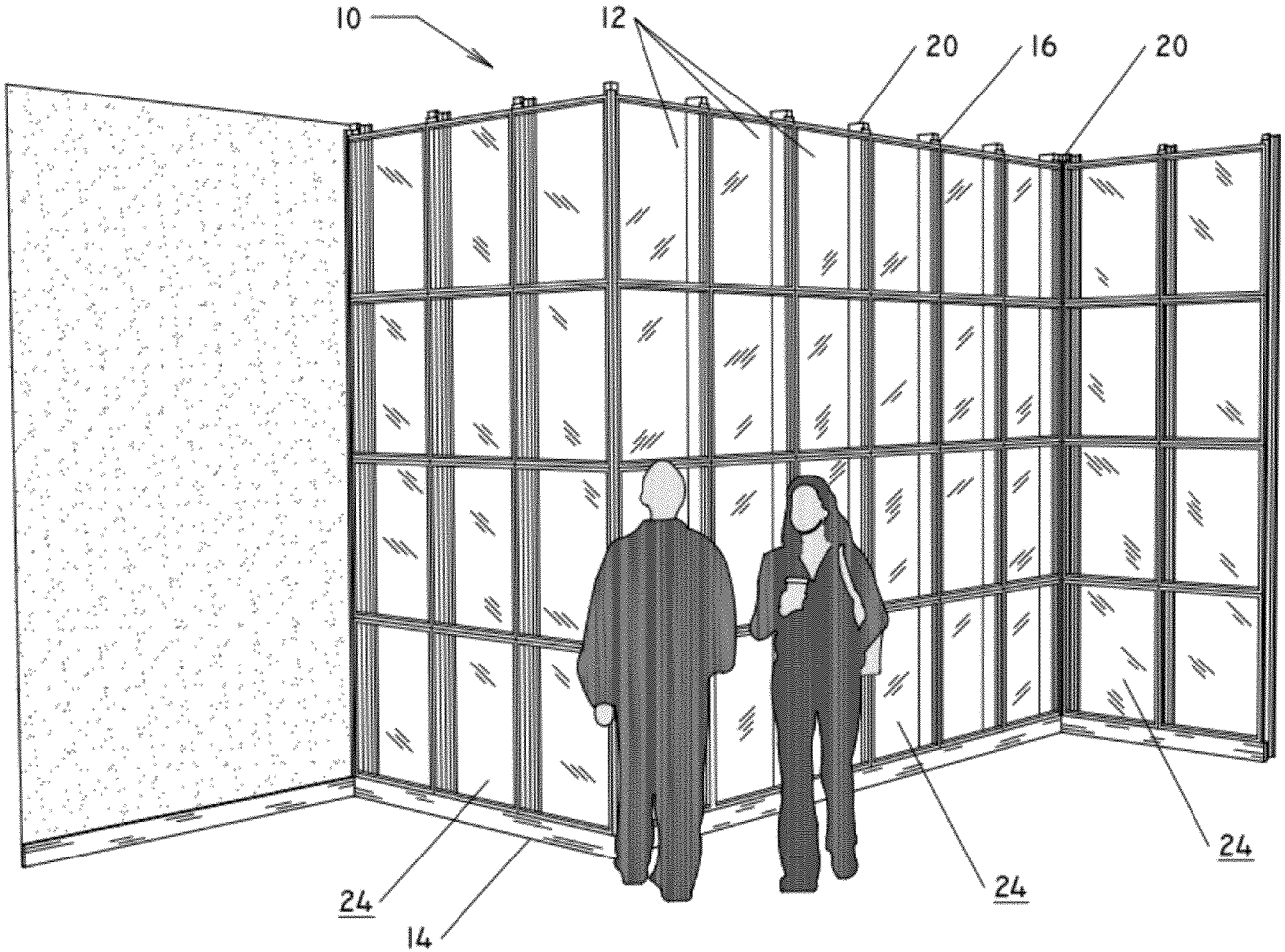
FIG. 1 illustrates a perspective view of a modular wall panel system according to one embodiment of the invention.

Referring now to the drawings, FIG. 1 shows a modular wall panel system 10 for use in industries such as healthcare, institutional, chain retail, chain restaurant, residential and contract/corporate interiors and the like that is constructed and assembled in accordance with an embodiment of the invention. The wall panel system 10 includes a number of rectangular or square decorative panels 12 arranged in an edge-to-edge manner to provide a finished wall surface. These individual panels 12 can be provided with substantially any desired surface finish. For example, the panels 12 may be provided with simulated wood grain, abstracts, masonry surfaces and the like. Similarly, the panels 12 may by provided with a wood veneer, a metal finish, high pressure laminates, solid colors, wood fiber surfaces, phosphate cement, fiber reinforced plastic or graphics. This list is only representative of the wide variety of surface finishes that may be provided and is not intended to be all inclusive. Further, the finish provided by individual panels 12 within a given wall need not be identical. Panels 12 of various finishes may be mixed when desired for special aesthetic effects. On the other hand, in many instances all of the panels 12 within a given wall assembly may be provided with substantially identical surface finishes. Suitable bottom trim 14 extends along the bottom edge of the wall panel system 10 to provide a finished wall panel appearance. One skilled in the art will also understand that suitable side and top edge trim may also be included without departing from the scope of the invention.

Figure 2:
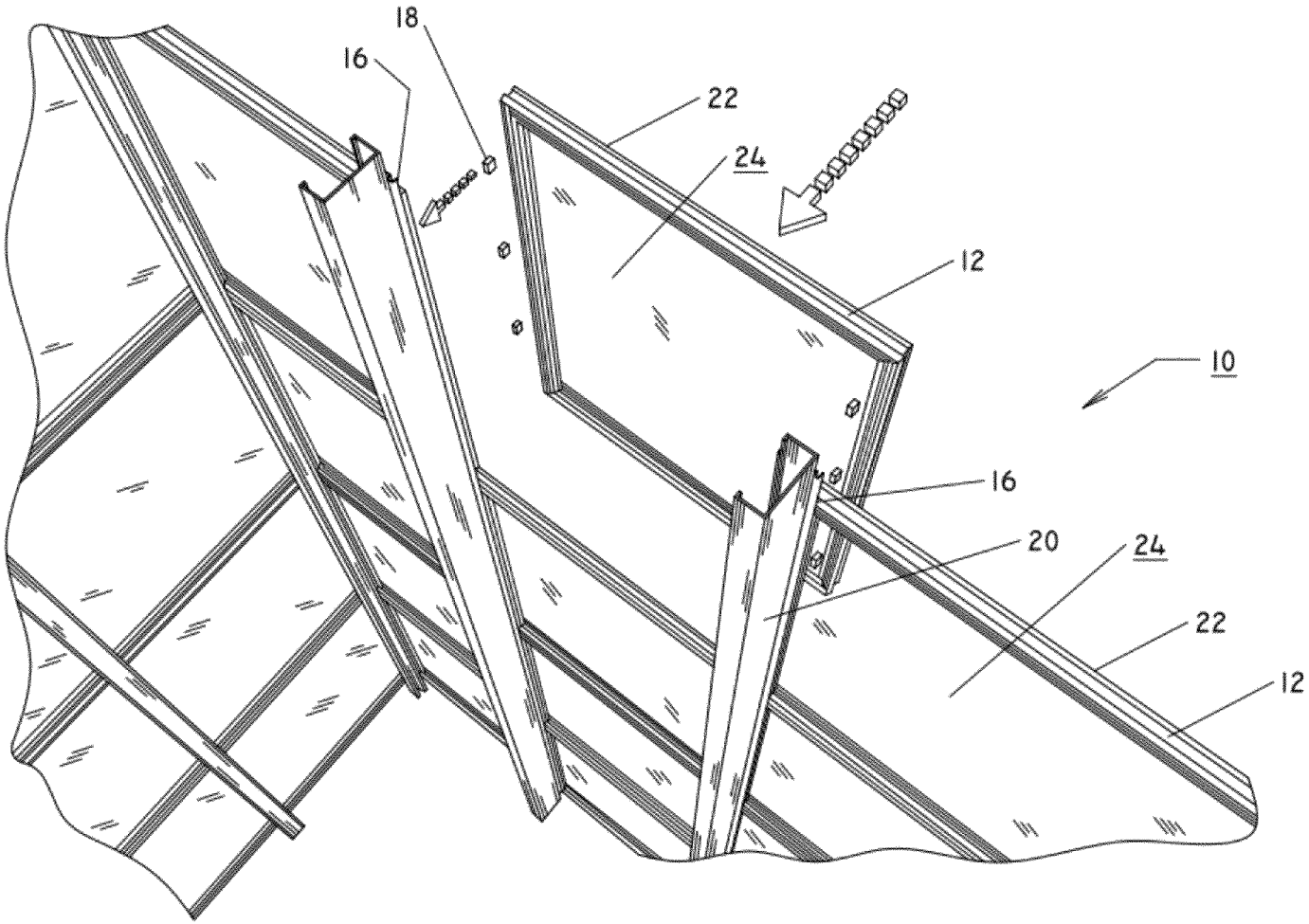
FIG. 2 illustrates a partially exploded view of a portion of the modular wall panel system of FIG. 1.

Referring now to FIG. 2, it can be seen that the panels 12 are positioned by connecting them to wall rails 16 with clips or fasteners 18 to insure that all of the panels within a given wall surface are properly positioned with respect to each other. The rails 16 are mounted on a supporting subwall, such as along studs 20, such that a rail 16 extends along each vertical joint between adjacent vertical courses of panels 12. Alternately, the rails 16 are mounted such that a rail 16 extends along each horizontal joint between adjacent horizontal courses of panels 12 without departing from the scope of the invention. Each of the panels 12 is constructed utilizing a panel frame 22 which encompasses the perimeter of a composite structural core 24. The wall rail 16 and the panel frame 22 each have a groove that accepts the fastener or clip 18 by interference or snap fit to attach the panel frame 22 to the wall rail 16 as will be more fully set forth below.

Figure 3:
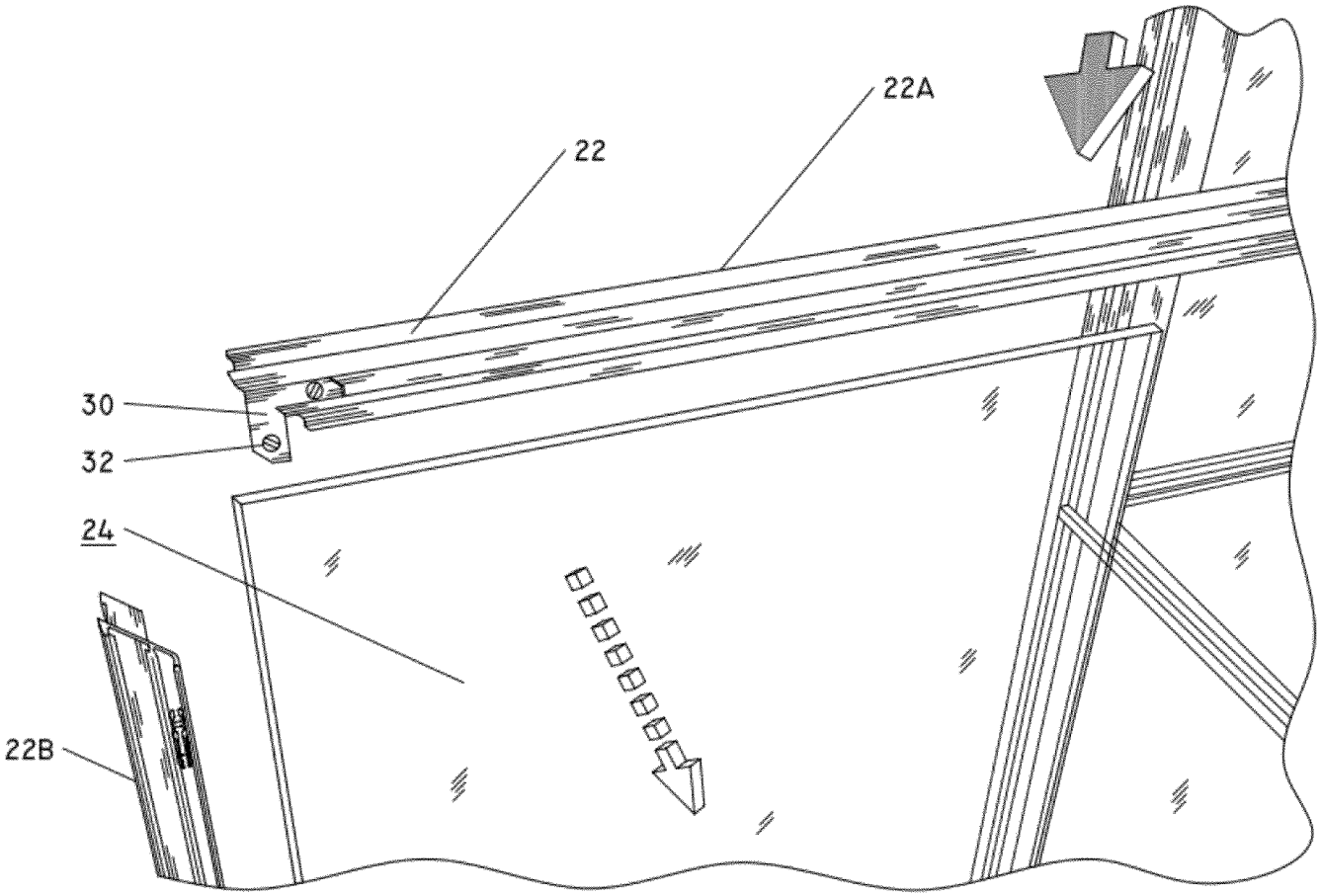
FIG. 3 is an exploded view of a portion of one panel of the modular wall panel system of FIG. 1.
Figure 4:
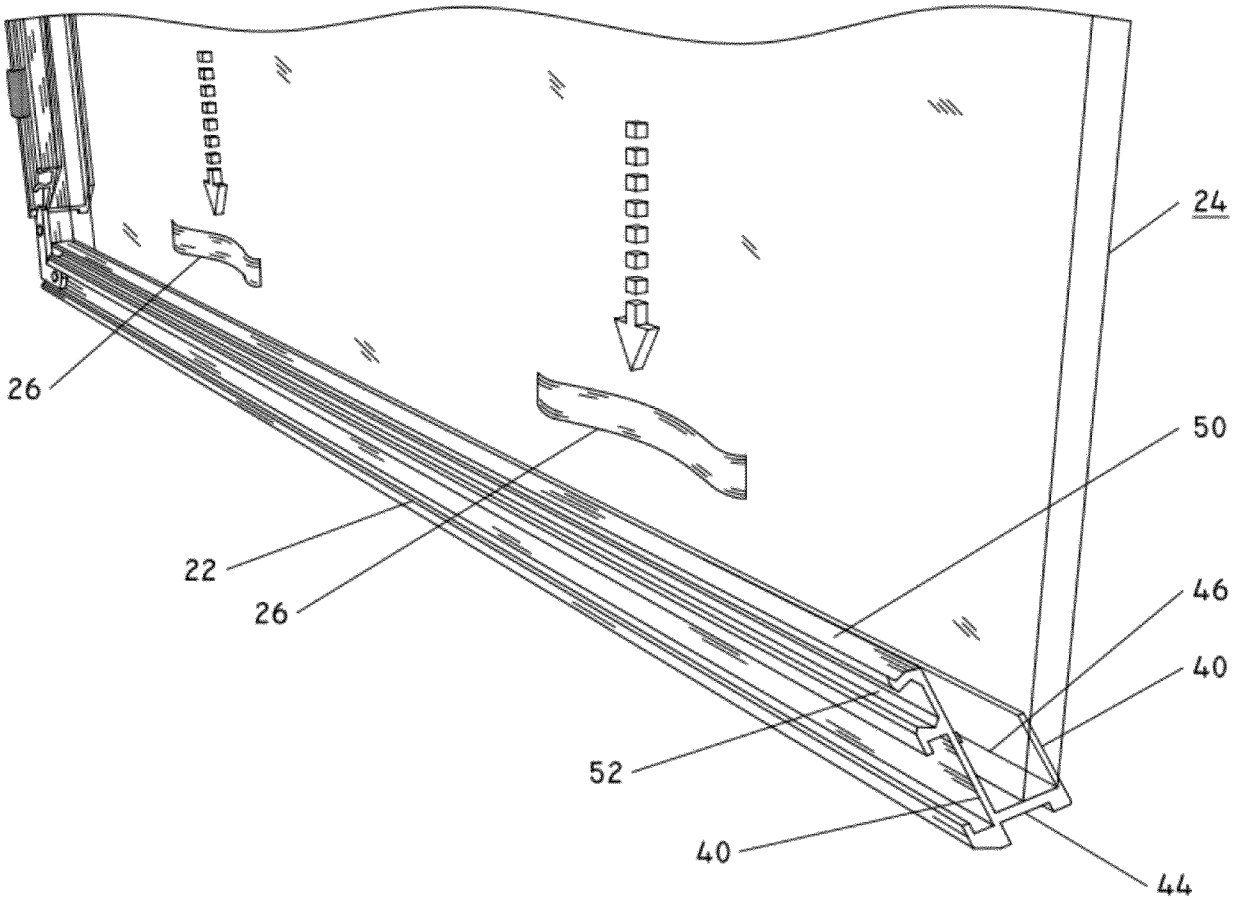
FIG. 4 is an exploded view of a portion of one panel of the modular wall panel system of FIG. 1.

Turning now to FIGS. 3 and 4, in one embodiment, the panels, which can be identical for the most part, are an assembly of a flat, rigid board-like core 24 held in place in the panel frame 22 with one or more retainer springs 26. The panel core 24 can comprise any suitable construction material and in one embodiment comprises a laminate of two outer face layers and an intermediate core 24. The core 24 can be commercially available particle board that consists primarily of wood particles bonded together with known materials. As best seen in FIG. 3, the panel frame 22 comprises a plurality of frame members (22A and 22B) extending along each of the outer edges of the core 24. Corner connectors 30, each located at a respective one of the corners of the frame assembly 22 and attached with suitable fasteners 32 thereby attaching adjacent ends of the frame members 22 together. Panels 12 of differing sizes can therefore easily be constructed by selecting the size of the core 24 and then cutting the panel frame 22 members to the required sizes and assembling the frame members using the corner connectors.

Figure 5:
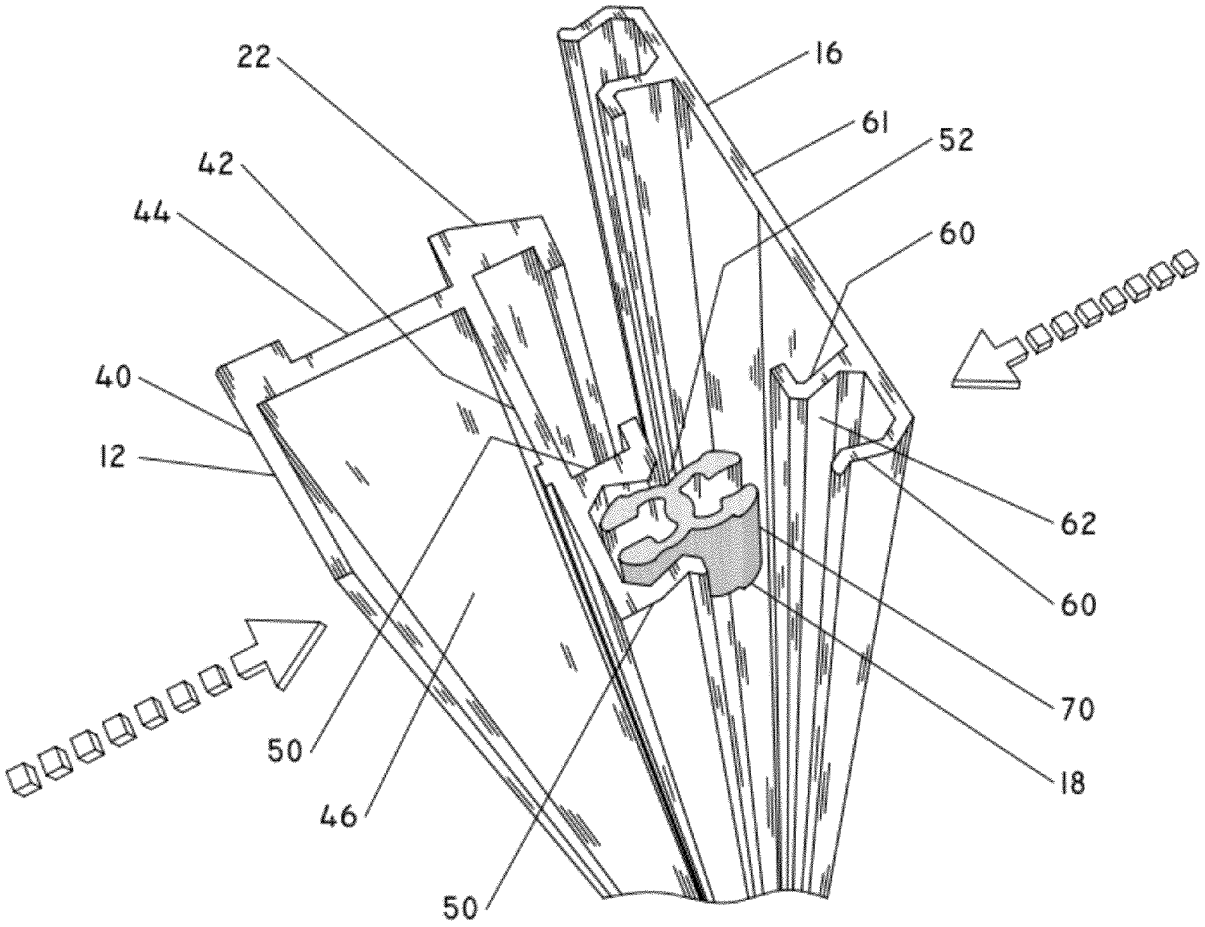
FIG. 5 is an exploded cutaway view of a panel connectable to a rail of the modular wall panel system of FIG. 1.

With reference particularly to FIG. 5, the perimeter frame members 22 comprise extruded members of substantially uniform cross-section along their lengths preferably made from aluminum or a synthetic plastics material such as rigid polyvinyl chloride (PVC). However, the frame members 22 may be made from other materials. Each frame member 22 includes a spaced apart pair of generally parallel primary flanges 40, 42 and a web 44 extending between and fixed to the primary flanges generally at right angles thereto to define a channel 46, which channel receives therein a marginal edge portion of the panel core 24. One flange 42 has a pair of groove-defining elements 50 forming a groove 52 configured to receive one or more mounting clips or fasteners 18. The groove-defining elements 50 are desirably in the form of spaced secondary flanges which are generally orthogonal to the primary flanges 40, 42. The groove-defining elements 50 form the groove 52 along the longitudinal length of the frame member 22. The groove 52 has a dove-tail shape that permits a clip or fastener 18 to be received in the groove with a snap fit.

Figure 6:
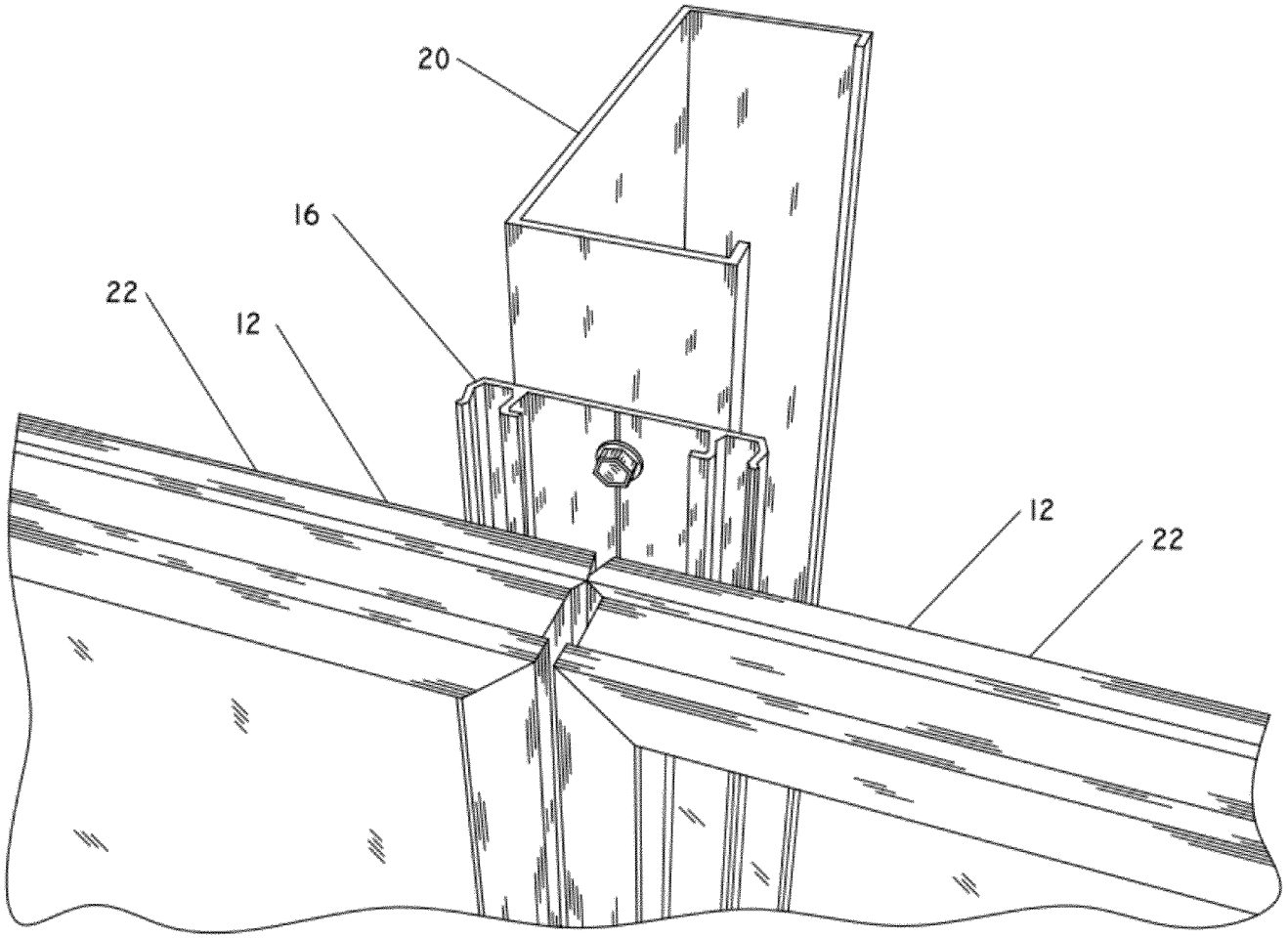
FIG. 6 is a perspective view of a portion of the modular wall panel system of FIG. 1.

Each rail 16 includes a spaced apart pair of generally parallel groove-defining elements 60 connected by a web 61 extending between and fixed to the groove-defining elements. The rails 16 comprise extruded members of substantially uniform cross-section along their lengths preferably made from aluminum or a synthetic plastics material such as rigid polyvinyl chloride (PVC). However, the frame members may be made from other materials. The shape of the groove 62 formed by elements 60 permits the insertion of clips or fasteners 18 to secure the panels 12 yet permit the panels to be easily removed or reconfigured. As shown in FIG. 5, groove 62 also has a dovetail configuration. The clips or fasteners 18 also provide a structure which accommodates a limited amount of panel expansion and contraction resulting from environmental temperature and humidity variations. The width of the web 61 is selected such that adjacent panels 12 are positioned with a close fit to form an attractive joint as illustrated in FIG. 6. Consequently, this invention provides a building element being a joining clip or fastener 18 adapted to mount a panel to the rail, the joining clip or fastener 18 having means for cooperating with a groove of the rail 16 and means for connecting the joining clip or fastener 18 to a panel or bracket. It is also contemplated that a snap-on decorative trim may cover the joint between two adjacent panels.

Figure 7:
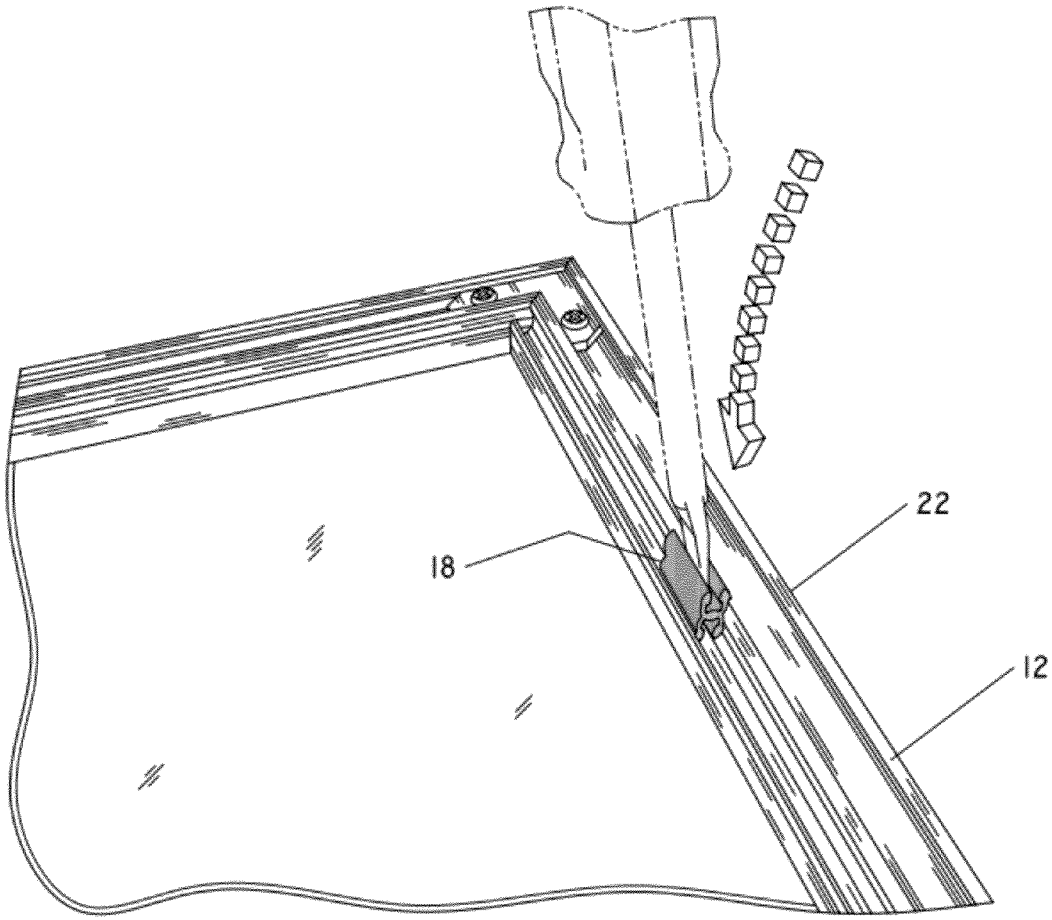
FIG. 7 is a perspective view of a fastener being inserted into or removed from a groove of a panel of the modular wall panel system of FIG. 1.
Figure 8:
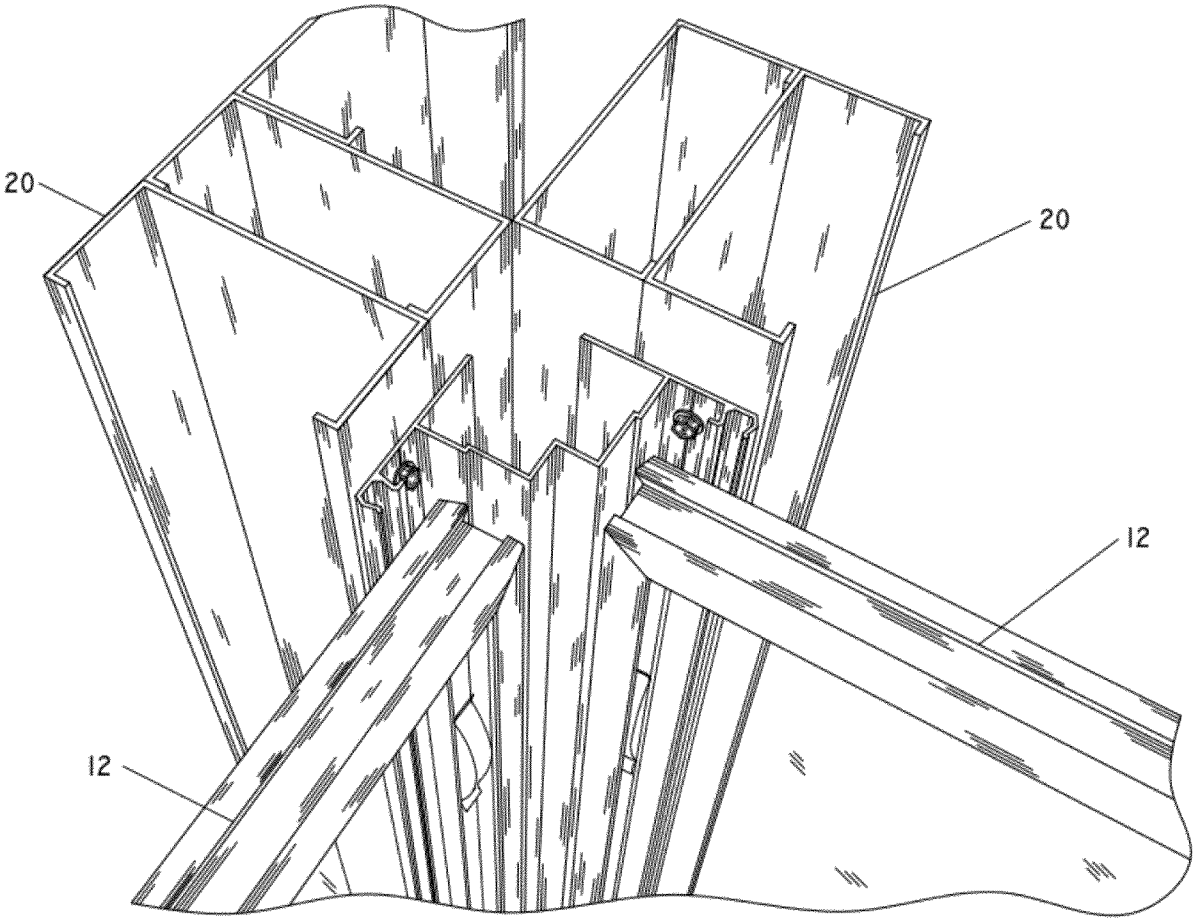
FIG. 8 is a perspective view of an inside corner portion of the modular wall panel system of FIG. 1.
Figure 9:
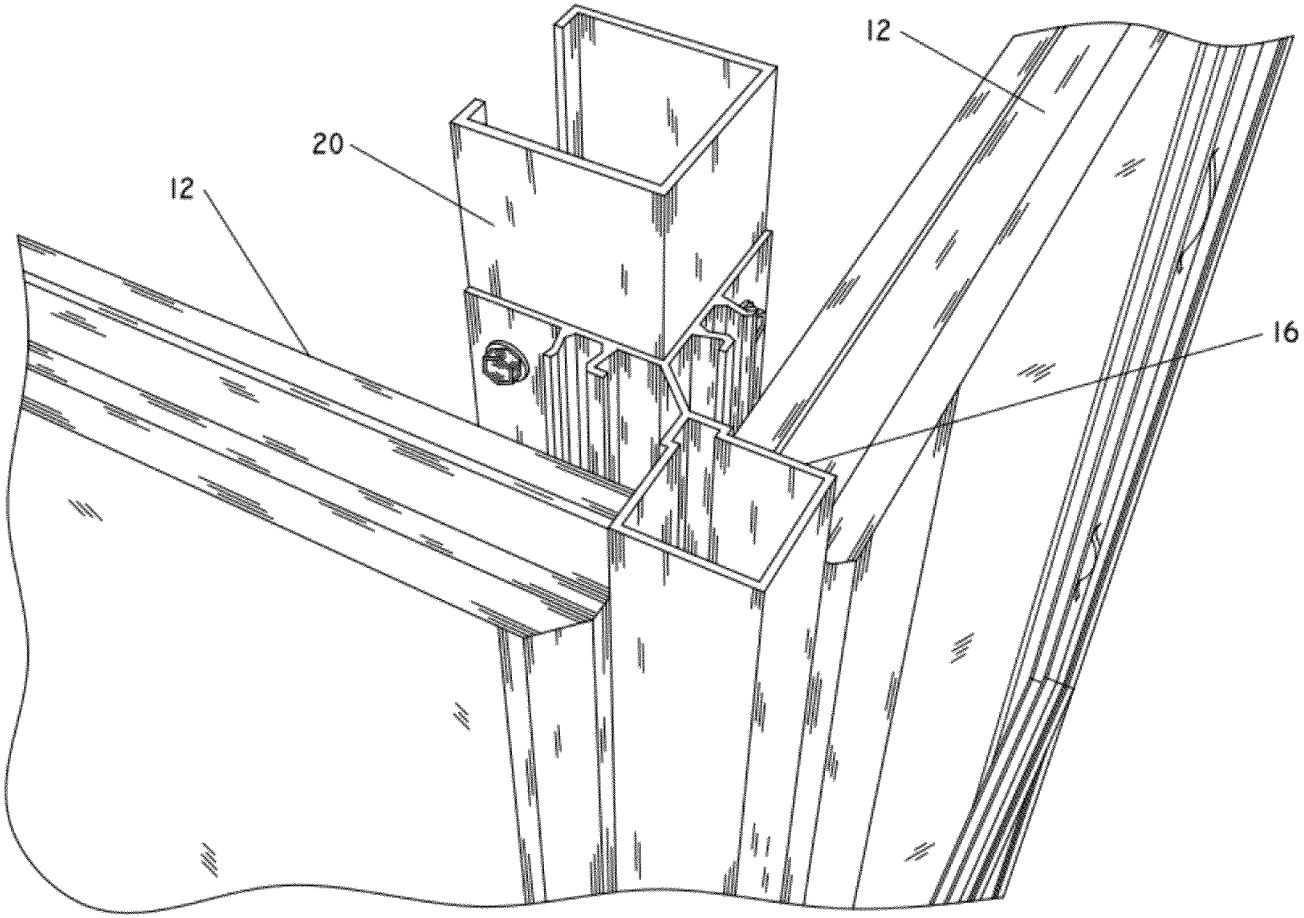
FIG. 9 is a perspective view of an outside corner portion of the modular wall panel system of FIG. 1.
Figure 10:
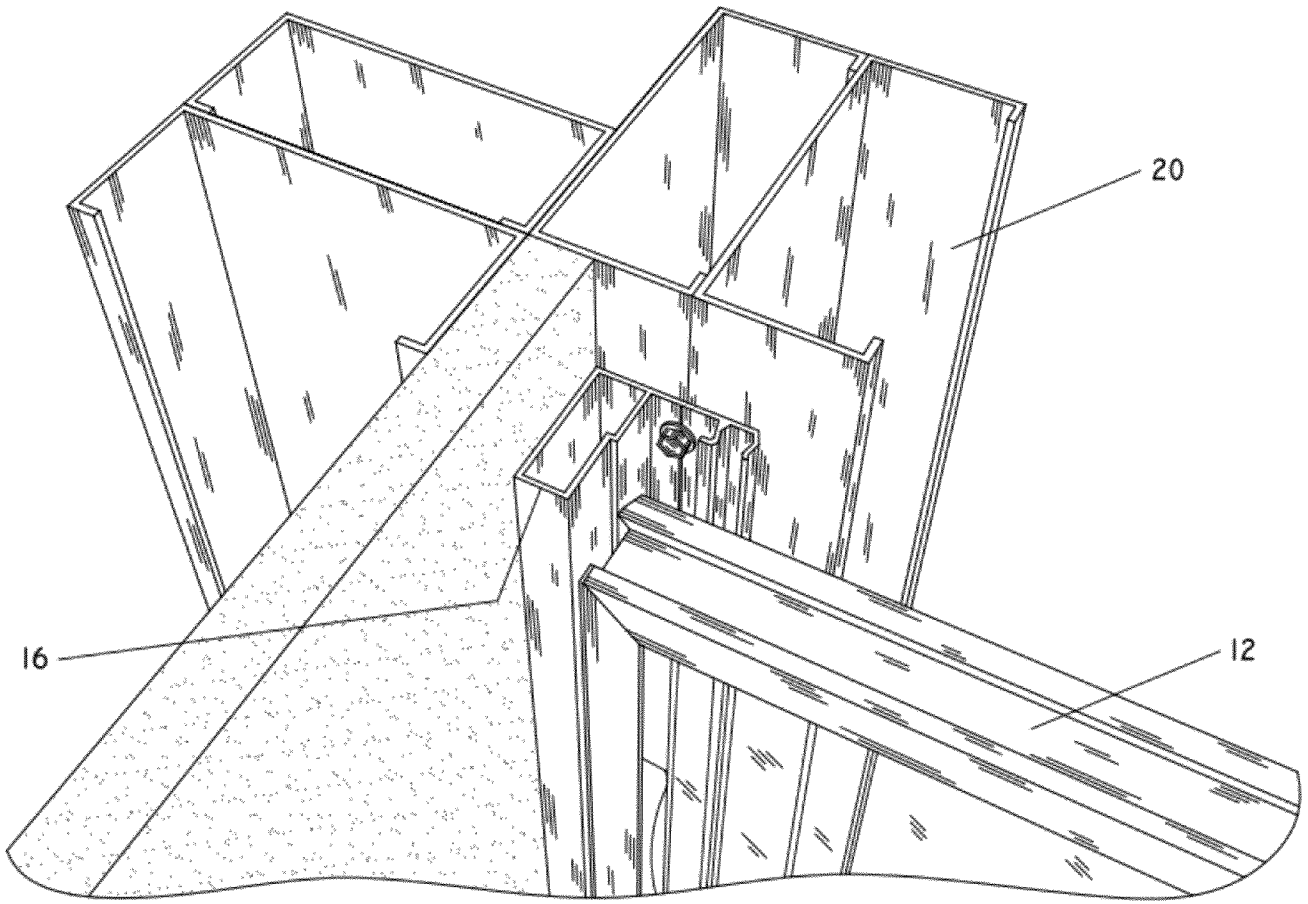
FIG. 10 is a perspective view of an end portion of the modular wall panel system of FIG. 1.

In a preferred embodiment, the joining clip or fastener 18 is symmetrical and has two substantially identical ends extending from a central body unit and is made of plastic such a polyvinyl chloride (PVC) or other suitable material. If desired, the joining clip or fastener 18 may have parts of varying resiliency, formed for example by multi-molding. The joining clip or fastener 18 may have protrusions 70 on each side of both ends of the clip or fastener 18, especially a toothed protrusion, which is push or friction fit into the dovetail shaped grooves 52, 62. Accordingly, a snap fit engagement is provided at both ends of the fastener with one end snap fit into the dovetail groove 52 of flange 42 formed on frame 22, and the other end of the symmetrical clip 18 snap engaged in groove 62 of rail 16. This method is illustrated in the drawings. It is intended that the material of the clip or fastener 18 and the close fit with the panel frame 22 and rail 16 provides a stable arrangement under normal conditions, but that the use of appropriate force will separate the clip or fastener 18 from the panel frame 22 and the rail 16 (for example, as seen in FIG. 7) when required, for example, so that the panel 12 can be repositioned. In the case of panels 12 around internal or external corners, the rail 16 is adapted to join a first panel to a second panel with suitable transition portions as seen in FIGS. 8 and 9. In the case of panels at an end of the wall system, the rail may desirable form a decorative end trim as shown in FIG. 10.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A modular wall system used to construct a wall surface, the system comprising:

a) a decorative wall panel;

b) a panel frame comprising at least a first member having a web and two flanges, said web and said flanges forming a unitary structure having a channel section, wherein an edge of said decorative wall panel is mounted within said channel section;

c) a pair of spaced wall rails mounted on a supporting subwall and between said subwall and said panel frame, with said panel frame extending between and connected to said pair of wall rails;

d) a panel frame groove;

e) a wall rail groove formed in each said wall rail;

f) a plurality of clips, each having a first and a second end with said first end snappingly engaging said panel frame groove and said second end snappingly engaging said wall rail groove.

2. The modular wall system as recited in claim 1 wherein said panel frame groove and said wall rail groove are dove-tail shaped.

3. The modular wall system as recited in claim 1 wherein said clips are each symmetrical with said first and second ends each having a pair of protrusions extending from a central body portion, said pair of protrusions being compressible toward each other upon snapping engagement into said panel frame groove on said wall rail groove.

4. A modular wall system used to construct a wall surface, the system comprising:

a decorative panel, a wall rail, and a clipping means for joining said panel frame to said wall rail;

a panel frame comprising at least a first member having a web an two flanges, said web and said flanges forming a unitary structure having a channel section;

an edge of said decorative panel being mounted within said channel section;

said wall rail being mounted to a supporting subwall and having a uniform cross section, and said wall rail being positioned between said subwall and said panel frame; and said clipping means snappingly engaging with a groove in said wall rail and a groove in said panel frame.

5. The modular wall system as recited in claim 4 wherein a plurality of wall rails are provided, and a plurality of decorative panels are provided in a disposition arranged in vertical courses and horizontal courses and wherein each said wall rail extends along each vertical joint between adjacent vertical courses of said decorative panels.

6. The modular wall system as recited in claim 4 wherein said wall rail comprises a pair of parallel groove defining elements connected by a web along the length of said wall rail.

7. The modular wall system as recited in claim 4 wherein said panel frame comprises a pair of primary flanges; said primary flanges being parallel and connected by a web; said web being fixed to said pair of primary flanges at a right angle and defining a channel adapted for receipt of a portion of said decorative panel therein.

8. The modular wall system as recited in claim 4 wherein said groove in said wall rail and said groove in said panel frame both accept said clipping means through interference fit therein.

9. The modular wall system as recited in claim 8 wherein said panel frame and said wall rail snap together when joined with said clipping means.

10. The modular wall system as recited in claim 4 further comprising a bottom trim extending along a bottom edge of said wall system and extending to a floor.

11. The modular wall system as recited in claim 4 further comprising a top trim extending along a top edge of said wall system to a ceiling.

12. A modular wall system used to construct a wall surface, the system comprising:

a decorative wall panel formed of a structural core, said wall panel having an edge mounted within a panel frame channel section, wherein said panel frame includes a groove formed therein, said frame further comprising at least a first member having a web and two flanges, said web and said flanges forming a unitary structure which form said channel section;

a pair of spaced wall rails mounted on a supporting subwall and between said subwall and said panel frame, wherein each of said spaced wall rails includes a groove formed therein; and at least one clip having a first end snappingly engageable within said groove formed in said panel frame and a second end snappingly engageable within said groove formed in one of said pair of spaced wall rails for securing said decorative wall panel to said pair of spaced wall rails.

13. The modular wall system of claim 12, wherein at least one of said groove formed in said panel frame and said groove formed in said pair of spaced wall rails is a dovetail groove.

14. The modular wall system of claim 12, wherein said first end of said clip is symmetric with respect to said second end of said clip.

15. The modular wall system of claim 12, wherein each of said at least one clip is formed of a central body with said first and second ends extending therefrom, said first and second ends being substantially identically shaped.

16. The modular wall system of claim 12, wherein each of said first and second ends are formed of a pair of toothed protrusions which are receivable within said grooves in said panel frame and said wall rails.

17. The modular wall system of claim 12, wherein each of said at least one clip is formed of parts having different resiliency formed by multi-molding.

* * * * *